United States Patent [19]

Sutherland

[11] Patent Number: 4,519,602

[45] Date of Patent: May 28, 1985

[54] PLAYGROUND CARROUSEL

[76] Inventor: Donald Sutherland, 6510 Micollet, Houston, Tex. 77016

[21] Appl. No.: 512,346

[22] Filed: Jul. 11, 1983

[51] Int. Cl.[3] ..... A63G 1/12

[52] U.S. Cl. ..... 272/33 R; 272/51

[58] Field of Search ..... 272/33 R, 33 A, 51, 272/28 R, 30

[56] References Cited

U.S. PATENT DOCUMENTS

| | | | |
|---|---|---|---|
| 1,402,368 | 1/1922 | Mongillo | 272/30 |
| 1,640,848 | 8/1927 | Norris | 272/30 |
| 1,791,227 | 2/1931 | Russell | 272/33 R |
| 2,841,395 | 7/1958 | Walker | 272/33 R |
| 2,995,369 | 8/1961 | Amble | 272/51 |
| 3,661,386 | 5/1972 | Green | 272/33 R |

FOREIGN PATENT DOCUMENTS

| | | | |
|---|---|---|---|
| 199236 | 6/1923 | United Kingdom | 272/30 |

*Primary Examiner*—Robert A. Hafer
*Assistant Examiner*—Arnold W. Kramer
*Attorney, Agent, or Firm*—Neal J. Mosely

[57] ABSTRACT

An amusement device comprises a rotatable tub in combination with a cooperative rotary carrousel which is occupant propelled. More particularly, the device comprises a pair of conventional automobile rear end differentials anchored in the ground and spaced apart, operatively connected by a drive shaft and transmission. One differential is anchored angularly and has a housing and axle extending upwardly therefrom to accept and support an inclined carrousel. The other differential has a housing and axle extending vertically therefrom to support a hollow tub mounted atop a platform. Individuals seated at opposite ends of the carrousel cause the axle to rotate by shifting their weight. Rotation of the angular axle is transmitted through one differential, the transmission, a universal joint, the drive shaft, and to the other differential which causes the vertical axle and tub to rotate. The tub may be used empty or filled with water and individuals seated therein are rotated with the tub by way of the rotary transmission arrangement of the inclined carrousel.

13 Claims, 1 Drawing Figure

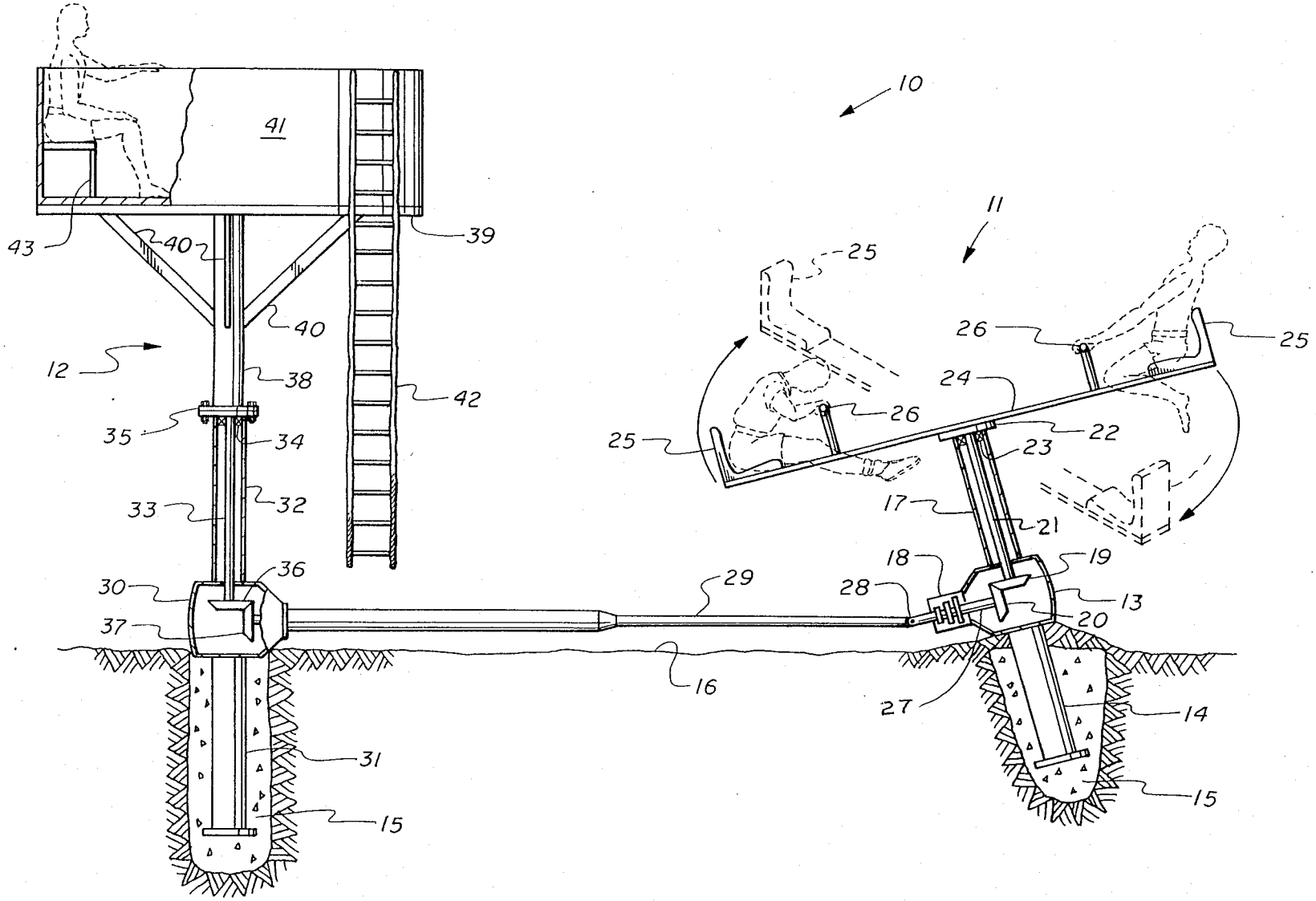
10
11
12
13
14
15
16
17
18
19
20
21
22
23
24
25
26
27
28
29
30
31
32
33
34
35
36
37
38
39
40
41
42
43

PLAYGROUND CARROUSEL

BACKGROUND OF THE INVENTION

1. Field of the Invention

This invention relates to occupant propelled carrousels and more particularly to an amusement device comprising a rotatable tub in combination with a cooperative rotary carrousel which is occupant propelled.

2. Brief Description of the Prior Art

Occupant propelled amusement devices and carrousels are known in the art. There are several patents which illustrate the state of the art of carrousels and amusement devices.

Willard, U.S. Pat. No. 3,439,914 discloses an inclined carrousel propelled by weight shifting of the occupants to change the center of gravity. The device comprises a body member rotatable in an oblique plane and carrying free turning seats at each end. To operate the carrousel, the seated occupant imparts a rotational force to cause the carrousel to rotate about its inclined or oblique axis. The carrousel is self contained and is not used as a driving or propelling means for other devices.

Eckberg, U.S. Pat. No. 1,670,882 discloses an amusement device for supporting people and allowing them to revolve around a stationary support. To operate the device, a person seated in the highest position leans back causing an increase in weight at the highest point of the wheel. A person on the lowest part of the wheel leans forward, causing a decrease in weight at the lowest point of the wheel. This device is also self contained and not used as a driving or propelling means for other devices.

Pricer, U.S. Pat. No. 2,497,372 discloses a combination swing and merry-go-round which is occupant propelled. The oscillating motion of the swing is converted into a rotary motion for transmission to the merry-go-round by means of a pawl and ratchet clutch mechanism mounted on the oscillating shaft and which drives a set of bevel gears to rotate the merry-go-round.

The prior art in general, and these patents in particular, do not disclose this invention which comprises an inclined occupant-propelled carrousel which rotates to drive a tub occupied by other persons. Rotary motion is transferred from the carrousel to the tub through a pair of opposing conventional automobile rear end differentials spaced apart and operatively connected by a drive shaft, universal joint, and transmission.

SUMMARY OF THE INVENTION

It is therefore one object of the invention to provide a combination carrousel and rotary tub connected whereby the carrousel will be rotated by the occupants thereof for transmitting rotary motion to the tub.

Another object of this invention is to provide a novel connecting means whereby the rotary motion of the carrousel is transmitted to the tub.

Another object of the invention is to provide a means whereby the ratio of the rotary motion of the carrousel and the tub may be selectively altered.

Another object of the invention is to provide an amusement device inexpensively manufactured from discarded materials.

Other objects of the invention will become apparent from time to time throughout the specification and claims as hereinafter related.

The above noted objects and other objects of the invention are accomplished by the present invention comprising an inclined occupant propelled carrousel which rotates to drive a tub occupied by other persons. Rotary motion is transferred from the carrousel to the tub through a pair of opposing conventional automobile rear end differentials spaced apart and operatively connected by a drive shaft, universal joint, and transmission.

BRIEF DESCRIPTION OF THE DRAWINGS

The sole FIGURE is a view in elevation of a novel playground carrousel with portions shown in cross section and the propelling and rotational motion illustrated schematically.

DESCRIPTION OF THE PREFERRED EMBODIMENT

Referring to the drawings by numerals of reference, there is shown a preferred combination amusement device 10 including an inclined rotary carrousel 11 and a rotatable tub 12. It should be noted that certain parts used in construction of the device are conventional and are shown in a simplified schematic form for ease of understanding by those skilled in the art.

A conventional automobile rear end differential 13 has one axle housing 14 embedded in concrete 15 below the surface of the ground 16 to form a support structure for the carrousel 11. The other axle housing 17 extends upwardly at an angle. A conventional automobile manual transmission 18 is bolted to one side of the differential 13 to provide a gear reduction means. The differential 13 contains a differential side gear 19 and drive pinion gear 20. An axle 21 extends upwardly inside the housing 17 from the side gear 19. A flange 22 is affixed to the extended end of the axle 21. A bearing 23 is located between the axle 21 and the inside of the axle housing 17 near its extended end to centralize the axle therein and provide smooth rotary motion therebetween. An elongated flat rectangular crossmember 24 is bolted at its center to the flange 22. Each end of the crossmember 24 is provided with a seat 25 and handle 26.

The main shaft 27 of the conventional transmission 18 has one end connected to the drive pinion gear 20 inside the differential 13 and its other end is provided with a universal joint 28. An elongated drive shaft 29 having one end attached to the universal joint 28 extends horizontally therefrom. The drive shaft 29 has its other end operatively connected to a second conventional automobile rear end differential 30 having one axle housing 31 embedded in concrete 15 below the surface of the ground 16 to form a support structure for the rotatable tub 12. The other axle housing 32 extends vertically from the differential and contains a conventional axle 33, axle bearing 34, and flange 35. The differential 30 contains a conventional differential side gear 36 and drive pinion gear 37. Those skilled in the art will easily understand that the unused portions of the differentials and transmission may be eliminated.

A flanged vertical column 38 having a platform 39 fixed at its top end and braces 40 welded angularly and axially therebetween is bolted to the flange 35 of the axle 33 to provide a tub support structure. A hollow cylindrical tub 41 is secured to the platform 39. A rope ladder 42 provides access to the tub 41. The tub 41 is provided with seats 43 and may be operated empty or may optionally be filled with water.

OPERATION

Referring again to the drawing, the principle of the operation can be seen. Individuals are seated in the seats 25 on opposite ends of the inclined crossmember 24 and hold onto the handles 26. When the person seated on the lower end of the crossmember 24 leans forward, the weight at the upper end will cause the crossmember 24 to rotate, indicated by arrows. As the person originally at the upper end reaches the lower end, the other person raises up to provide the added weight and the person at the lower end leans forward to shift the center of gravity and keep the crossmember 24 turning. The crossmember will continue to rotate as the persons shift their weight.

The rotary motion thus created by the carrousel 11 is transmitted through the inclined axle 21 and to the differential side gear 19. The side gear 19 cooperates with the drive pinion gear 20 to transfer the rotary motion to the mainshaft 27 of the transmission 18. The appropriate transmission gear is pre-engaged to provide the desired gear reduction ratio. From the transmission 18, the rotary motion is transmitted to the universal joint 28 and through the drive shaft 29 to the other differential 30 where the other drive pinion gear 37 drives the side gear 36 to rotate the axle 33 and tub support structure. Individuals seated in the tub 41 are rotated with the tub. If first gear is selected at the transmission, the carrousel will rotate two and one-half times as fast as the tub and will provide more torque to turn the tub. If second gear is selected, the ratio would be somewhat less than two to one, and the tub would rotate faster. If third gear is selected, the carrousel and the tub would rotate at the same speed.

While this invention has been described fully and completely with special emphasis upon a preferred embodiment, it should be understood that within the scope of the appended claims the invention may be practiced otherwise than is specifically described herein.

I claim:

1. An amusement carrousel apparatus, comprising a carrousel supporting structure extending from the ground at a small angle from the vertical for supporting a carrousel in an inclined position, an occupant actuated and occupant supporting carrousel having a pivot supported angularly for rotary movement by said carrousel supporting structure, an axle fixed to the carrousel at the pivot thereof for rotary movement with said carrousel and journaled in the carrousel supporting structure, a first gear means mounted in said carrousel supporting structure and connecting to said axle, a driving shaft extending horizontally from and operatively connected to said gear means, a tub supporting structure extending vertically from the ground and having a supporting platform spaced from the carrousel supporting structure for supporting a tub thereon, an axle journaled in said tub supporting structure for rotary movement with said supporting platform, a second gear means mounted in said tub supporting structure and operatively connecting said axle to the other end of said driving shaft, and a hollow cylindrical tub secured atop said supporting platform, whereby, rotation of said carrousel by the occupants thereof shifting their weights is effective to transmit rotary motion to rotate said tub.

2. An amusement carrousel apparatus according to claim 1 wherein said first and second gear means are anchored in the ground.

3. An amusement carrousel apparatus according to claim 1 wherein said occupant actuated and occupant supporting carrousel comprises an elongated cross member supported for rotary movement by said carrousel supporting structure and having seats and handles at opposite ends thereof, whereby occupants of said seats can effect rotation of said carrousel by shifting their respective weights foreward and backward or from side to side.

4. An amusement carrousel apparatus according to claim 3 wherein said gear reduction means is a manual automobile transmission.

5. An amusement carrousel apparatus according to claim 1 including gear reduction means operatively connected to said first gear means and to said driving shaft for selectively changing the ratio of rotation therebetween.

6. An amusement carrousel apparatus according to claim 1 wherein said carrousel supporting structure for supporting a carrousel in an inclined position is an automobile differential having a first axle housing extending angularly downward and anchored in the ground and a second axle housing extending angularly upward.

7. An amusement carrousel apparatus according to claim 1 wherein said tub supporting structure having a tub supporting platform is an automobile differential having a first axle housing extending vertically downward and anchored in the ground and a second axle housing extending vertically upward.

8. An amusement carrousel apparatus, comprising a carrousel supporting structure extending from the ground at a small angle from the vertical for supporting a carrousel in an inclined position, an occupant actuated and occupant supporting carrousel having a pivot supported angularly for rotary movement by said carrousel supporting structure, said occupant actuated and occupant supporting carrousel comprising an elongated cross member supported for rotary movement by said carrousel supporting structure and having seats and handles at opposite ends thereof, whereby occupants of said seats can effect rotation of said carrousel by shifting their respective weights foreward and backward or from side to side, an axle fixed to the carrousel at the pivot thereof for rotary movement with said carrousel and journaled in the carrousel supporting structure, a first gear means, anchored in the ground, in said carrousel supporting structure and connecting to said axle, a driving shaft extending horizontally from and operatively connected to said gear means, gear reduction means operatively connected to said first gear means and and to said driving shaft for selectively changing the ratio of rotation therebetween, a vertical tub supporting structure having a supporting platform spaced from the carrousel supporting structure for supporting a tub thereon, an axle journaled in said tub supporting structure for rotary movement with said supporting platform, a second gear means, anchored in the ground, in said vertical tub supporting structure and operatively connecting said axle to the other end of said driving shaft, and a hollow cylindrical tub secured atop said supporting platform, whereby, rotation of said carrousel by the occupants thereof is effective to transmit rotary motion to rotate said tub.

9. An amusement carrousel apparatus according to claim 8 wherein said carrousel supporting structure for supporting a carrousel in an inclined position is an automobile differential having a first axle housing extending angularly downward and anchored in the ground and a second axle housing extending angularly upward.

10. An amusement carrousel apparatus according to claim 8 wherein said tub supporting structure having a tub supporting platform is an automobile differential having a first axle housing extending vertically downward and anchored in the ground and a second axle housing extending vertically upward.

11. An amusement carrousel apparatus according to claim 8 wherein said gear reduction means is a manual automobile transmission.

12. An amusement carrousel apparatus, comprising a carrousel supporting structure extending from the ground at a small angle from the vertical for supporting a carrousel in an inclined position, an axle fixed to the carrousel at the pivot thereof for rotary movement with said carrousel and journaled in the carrousel supporting structure, an occupant actuated and occupant supporting carrousel having a pivot supported angularly for rotary movement by said carrousel supporting structure, and a first gear means mounted in said carrousel supporting structure and connecting to said axle, second gear means mounted in said carrousel supporting structure driven by said first gear means, said carrousel supporting structure having means connected to said second gear means being adapted for connection to a driving shaft extending horizontally therefrom for operation of an external structure, said occupant actuated and occupant supporting carrousel comprising an elongated cross member supported for rotary movement by said carrousel supporting structure and having seats and handles at opposite ends thereof, whereby occupants of said seats can effect rotation of said carrousel by shifting their respective weights foreward and backward or from side to side.

13. An amusement carrousel apparatus according to claim 12 wherein said carrousel supporting structure for supporting a carrousel in an inclined position is an automobile differential having a first axle housing extending angularly downward and anchored in the ground and a second axle housing extending angularly upward, said carrousel being supported on the end of a shaft extending to and rotating on said differential.

* * * * *